US007976400B1

(12) United States Patent
Pottorff

(10) Patent No.: US 7,976,400 B1
(45) Date of Patent: Jul. 12, 2011

(54) GOLF PUTTER WITH ADJUSTABLE LIE

(76) Inventor: Earl T. Pottorff, Savannah, NY (US)

( * ) Notice: Subject to any disclaimer, the term of this patent is extended or adjusted under 35 U.S.C. 154(b) by 0 days.

(21) Appl. No.: 12/983,905

(22) Filed: Jan. 4, 2011

(51) Int. Cl.
*A63B 69/36* (2006.01)
*A63B 53/02* (2006.01)
*A63B 53/06* (2006.01)

(52) U.S. Cl. ..... 473/248; 473/251; 473/305; 473/313; 473/314; 473/340

(58) Field of Classification Search ..... 473/244–248, 473/305–315, 340–341, 251
See application file for complete search history.

(56) References Cited

U.S. PATENT DOCUMENTS

| | | | | | |
|---|---|---|---|---|---|
| 1,250,296 | A | * | 12/1917 | Fitzjohn | 473/313 |
| 2,478,468 | A | * | 8/1949 | Drake | 473/313 |
| 3,448,981 | A | * | 6/1969 | Anweiler | 473/314 |
| 3,675,923 | A | * | 7/1972 | Allen et al. | 473/313 |
| 3,989,257 | A | * | 11/1976 | Barr | 473/251 |
| D264,366 | S | * | 5/1982 | Roskopf et al. | D21/741 |
| D272,257 | S | * | 1/1984 | Perkins | D21/759 |
| 4,702,477 | A | * | 10/1987 | Solomon | 473/313 |
| 4,722,528 | A | * | 2/1988 | Tsao | 473/254 |
| 5,253,869 | A | | 10/1993 | Dingle et al. | |
| 5,267,733 | A | * | 12/1993 | Szokola | 473/313 |
| 5,340,104 | A | * | 8/1994 | Griffin | 473/340 |
| 5,340,106 | A | * | 8/1994 | Ravaris | 473/328 |
| 5,344,141 | A | * | 9/1994 | Smith | 473/314 |
| 5,382,019 | A | * | 1/1995 | Sneed | 473/304 |
| 5,390,919 | A | | 2/1995 | Stubbs et al. | |
| 5,462,279 | A | * | 10/1995 | Culpepper | 473/248 |
| 5,685,784 | A | * | 11/1997 | Butler | 473/340 |
| 5,709,613 | A | * | 1/1998 | Sheraw | 473/248 |
| 5,795,246 | A | * | 8/1998 | Hale | 473/340 |
| D401,991 | S | * | 12/1998 | Collins | D21/744 |
| 5,928,089 | A | * | 7/1999 | Smith | 473/314 |
| 6,497,626 | B1 | * | 12/2002 | Sundberg | 473/248 |
| 7,410,423 | B2 | | 8/2008 | Pinder | |
| 2002/0115498 | A1 | | 8/2002 | Galliers | |
| 2007/0265109 | A1 | * | 11/2007 | Elmer | 473/340 |
| 2008/0146372 | A1 | | 6/2008 | John | |

FOREIGN PATENT DOCUMENTS

| | | |
|---|---|---|
| WO | WO 82/01827 A1 | 6/1982 |

* cited by examiner

*Primary Examiner* — Sebastiano Passaniti
(74) *Attorney, Agent, or Firm* — Bernhard P. Molldrem, Jr.

(57) ABSTRACT

A putter head is positioned to be even with the ball when the shaft is at the vertical plane of the ball. The lie of the shaft can be adjusted relative to the head between limits. An insert in the club head secures the tip of the crook of the shaft. A worm gear permits infinite adjustment of lie within a range. The insert can be of different weights to weight the club for various conditions.

10 Claims, 6 Drawing Sheets

GOLF PUTTER WITH ADJUSTABLE LIE

BACKGROUND OF THE INVENTION

This invention relates to sporting equipment and in particular to golf clubs, and more specifically to putters. The invention is directed to a golf putter having a shaft and head in which the shaft has a shepherd's crook or gooseneck portion at its lower end, and this enters the body of the putter head horizontally. The invention is also concerned with a putter in which the lie of the club, i.e., the angle that the axis of the shaft makes in respect to the sole of the club head, can be adjusted over a range, and in which the same club can be set for right handed or left handed play.

Putters are golf clubs for use on the putting green, and are used for stroking the golf ball in a manner such that contact with the ball will roll the ball towards the hole, and hopefully into the hole. It is best if the putter can be individualized for each golfer, because each golfer has an individual stance and stature, and an individual swing plane, and for a given golfer the right eye may be the dominant eye while for another the left eye may be dominant. This is true for right-handed and left-handed players. Also, the golfer's preferences may change over time, and may vary from one course to another for any of a variety of reasons.

Some golf putters have been proposed that could be adjusted to the individual golfer, including selecting the lie of the club. These have invariably required incremental adjustment however, and so the adjustment for a given golfer could be approximate, at best.

Balance and weight of the club head are important factors also, as the swing of a golfer can vary between light and heavy, and the weight of the club can affect the travel of the ball across the green towards the hole.

OBJECTS AND SUMMARY OF THE INVENTION

Accordingly, it is an object of this invention to provide an improved putter that better matches the golfer's preferences and characteristics, and improves the travel of the golf ball across the green, towards and into the hole.

Another object is to provide a golf club that can be easily changed between right hand and left hand configurations, and in which the lie, or angle of the shaft axis to the sole of the club head, can be infinitely adjusted within a range (e.g., 10° to about 35°).

It is another object of the invention to provide a putter in which the shaft axis is aligned with the zone of the club face that contacts the golf ball.

It is a further object to provide a putter in which the lower end of the shaft extends horizontally into the body of the club head, on a line with the zone of the club face that contacts the ball.

It is another object in which an insert that anchors the tip or end of the shaft to the club head can be interchanged or adjusted to optimize the weight of the putter head.

According to one aspect of the present invention, the head of the putter has a body, which may be generally rounded and elongated from front to back, with a sole or bottom surface, a face at a distal end (facing the ball) and a back at a proximal end (opposite the ball). The putter shaft has a main straight elongated shaft portion that defines a shaft axis, and a gooseneck or shepherd's crook portion at a lower end of the main shaft portion. The gooseneck portion turns proximally from the plane of the shaft axis at the lower end of the straight main shaft portion and then curves the other direction through more than 90 degrees to the distal direction, such that the lower end of the gooseneck portion lies in a horizontal plane perpendicular to the shaft axis. The body of the head portion has an insert cavity. An insert (in which the end of the gooseneck is anchored) is removably secured into the insert cavity. There is a generally C-profile trough that extends distally, from the back of the head to the insert cavity. The insert includes a mechanism that captures the tip of said gooseneck portion and holds the shaft so that the horizontal lower end of the gooseneck portion lies within the trough. The insert holds the gooseneck portion of the shaft such that the axis of the shaft lies substantially in the plane of the club face. The mechanism also permits adjustment of the lie of the shaft relative to the sole of the club head, within a continuous range between limits of substantially 10 degrees from vertical, relative to the sole and maximum angle between 10 degrees and horizontal (typically 35 degrees or 55 degrees from horizontal). In a favorable embodiment, the insert is in the form of a generally rectangular block fitted into a corresponding rectangular insert cavity.

The mechanism that captures the tip of the gooseneck portion and permits adjustment of the lie of the shaft can take the form of a worm drive incorporated into the insert, with a spur gear retained on the tip of the gooseneck portion and a worm gear that is transversely disposed in the insert and is accessible through a bore in the club head. An allen wrench or hex wrench can be inserted in that bore, and turned to make adjustments of lie angle. Favorably, there is a blocking device in the insert that preventing rotation of the gooseneck portion to an angle less than 10 degrees from vertical of the shaft axis relative to the club sole. The blocking device can be adjusted with the lie of the shaft set to either side of vertical, so that the putter can be adjusted for either right-handed or left-handed play. In the preferred embodiment, the insert is formed of a lower base portion and an upper clamp portion that releasably secures the tip of the gooseneck portion. The base and clamp portions define at least one limit cavity between them. The tip of the gooseneck portion has a limit pin that extends radially out and is situated within limit cavity. Two walls of the limit cavity defining rotational limits for the gooseneck portion of the shaft.

The upper and lower parts of the insert can be made of various materials, some light-weight and some heavier, so that different inserts can be interchanged, to change the weight of the club head.

In the putters that embody this invention, the head is positioned to be even with the ball when the shaft is at the vertical plane of the ball, and the shaft angle can be adjusted relative to the head, either for small adjustments of angle or to swing over to the opposite side for use by left handed players. The block or insert that holds the head to the crook of the shaft can be made of any of a number of materials of different weight so the head can be adjusted as to weight for different conditions (wet green, fast green, etc.) prior to play.

Major novel features are as follows:

The crook of the shaft comes into the putter head parallel with the ground and is secured in the insert. The insert favorably includes a worm gear drive, rotated via a tool inserted into an opening in the club head, so the golfer can change the lie of the putter sole in relation to the shaft angle. The golfer can select an optimum angle (except for a forbidden interval between +10° and −10° from vertical) and can adjust the club for RH or LH play. In some implementations, there can be different inserts for right-hand and left-hand set up, while in others change over from right-hand to left-hand can be carried out by a simple adjustment in the insert. The requirement of a special tool for the rotating of the worm gear ensures that the club is only adjusted before play, and not during a match. In a favored embodiment a stop pin in a through hole in the shaft and a blocking element in the insert stop rotation at 80° from horizontal (10° from vertical) so shaft angle adjustment is limited from about 55° to 80°. By pushing this pin through for left hand settings, the shaft angle can be adjusted between 100° and 125°, symmetric with the RH configuration. The shaft angle is infinitely adjustable between these limits, on either side.

The upper, main part of the shaft is directly over the ball, and the crook lower end curves behind the putter head and then bends an arc at 90° at the bottom so the shaft is oriented directly into the face of the putter directed at the point of impact with the ball, while the vertical part of the shaft is exactly aligned with the top of the ball at the point of impact.

The insert that joins the shaft to the putter head can be made from various materials of different weight, e.g., plastic, aluminum, brass or stainless steel, to allow the golfer to change the weight of the putter head and the feel of the strike of the ball. The weight of the club can be adjusted prior to play so as to weight the club for different conditions, i.e., wet green, fast green, etc.

The putter can be used for either right- or left-handed use simply by rotating the shaft to the other side, and adjusting the grip (if necessary) where now almost all putters are made separately for right or left handed players. However, as this involves removing the insert from the club head, this is a procedure that would have to be performed prior to play, which conforms the putter to rules of golf that forbid changing the characteristics of the club on the course.

The above and many other objects, features, and advantages of this invention will become apparent from the ensuing description of an exemplary embodiment, which should be read in conjunction with the accompanying Drawing.

DETAILED DESCRIPTION OF THE PREFERRED EMBODIMENT

Figure 4:
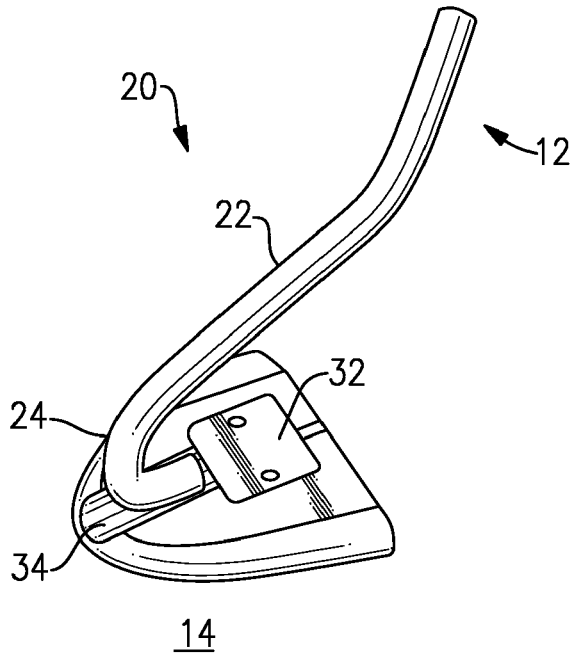
FIG. 4 is a rear quarter perspective view of the putter head this embodiment.
Figure 1:
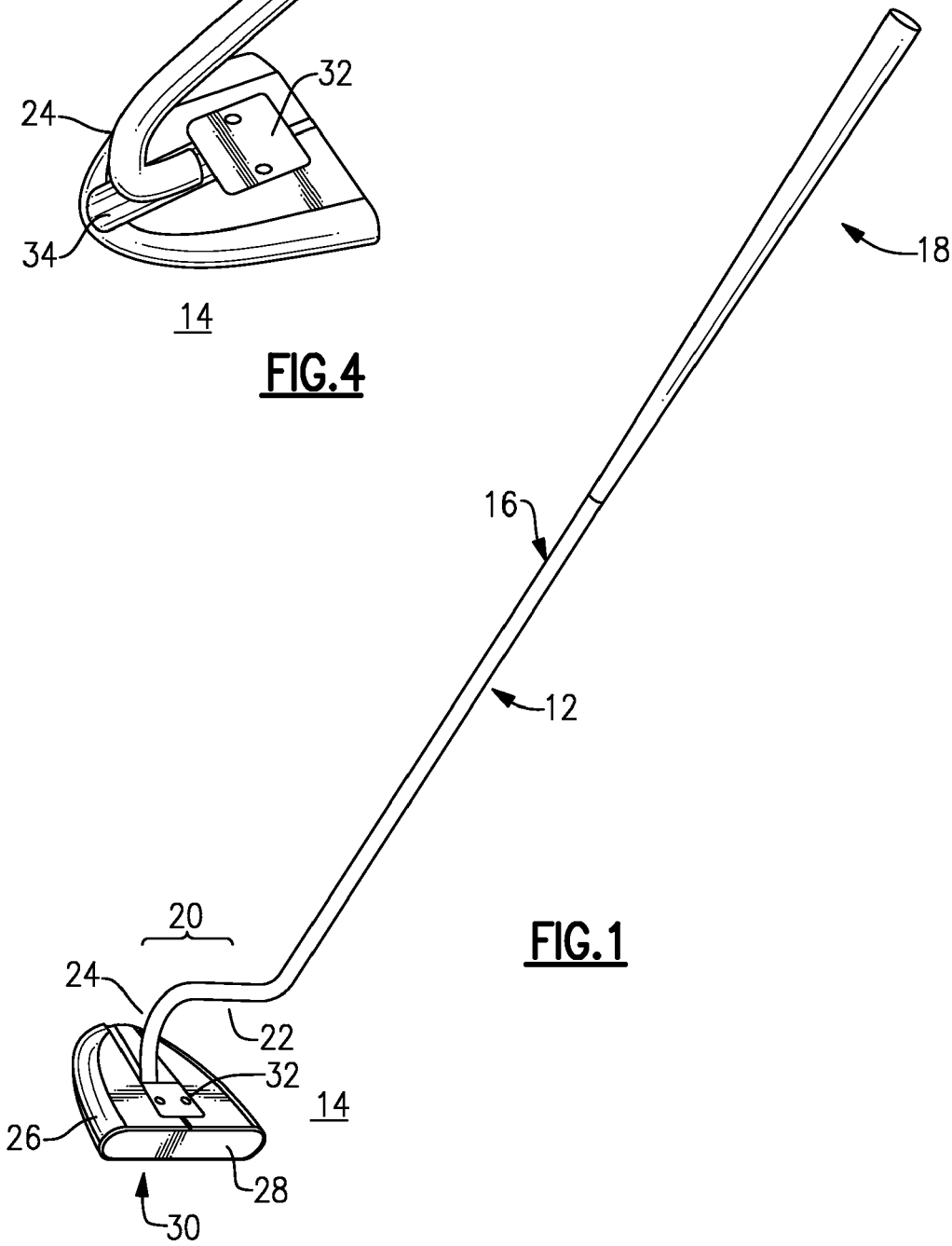
FIG. 1 is a perspective assembly view of a putter according to one preferred embodiment of the invention.

With reference to the Drawing, FIGS. 1 to 4 show an improved putter according to one favorable embodiment of this invention.

The putter 10 is comprised of a shaft 12 and a head 14. The shaft 12 has a main straight upper portion 16, which defines the axis A of the shaft, with a wrap or grip 18 at its upper end, and with a curved gooseneck portion 20 at its lower end connecting the straight shaft portion 16 with the club head 14. Here the gooseneck portion 20 and straight portion 16 are unitary and formed as a single piece, but in other implementations the gooseneck portion could be formed as a hosel fitted into the putter head 14 with the straight shaft portion 16 being fitted into the hosel.

The gooseneck portion has a first angled portion 22 that bends distally away from the lower end of the straight portion 16 and continues down to a recurve 24, below which the gooseneck portion 20 continues distally, i.e., forward, and enters the club head 14.

The club head 14 has a main body 16 which here has a generally semi-elliptical profile, viewed from above, formed with a generally flat face 28 on a distal (golf-ball facing) side and a sole 30 at its under side. The body 26 narrows to a rounded back end. The lower end of the gooseneck 20 is held in an insert 32 that is fitted into the body 26 of the club head. As shown better in FIGS. 2 and 4, the body has a elongated recess or trough 34 that extends from the rear or proximal end of the body 26 to an insert cavity 36 into which the insert 32 is seated. The lower end of the gooseneck 20 extends horizontally through the trough 34 to where it is gripped in the insert 32. As shown in FIG. 3, the axis A of the shaft 12 aligns with the face 28 of the putter at the point where it contacts the golf ball B.

Figure 2:
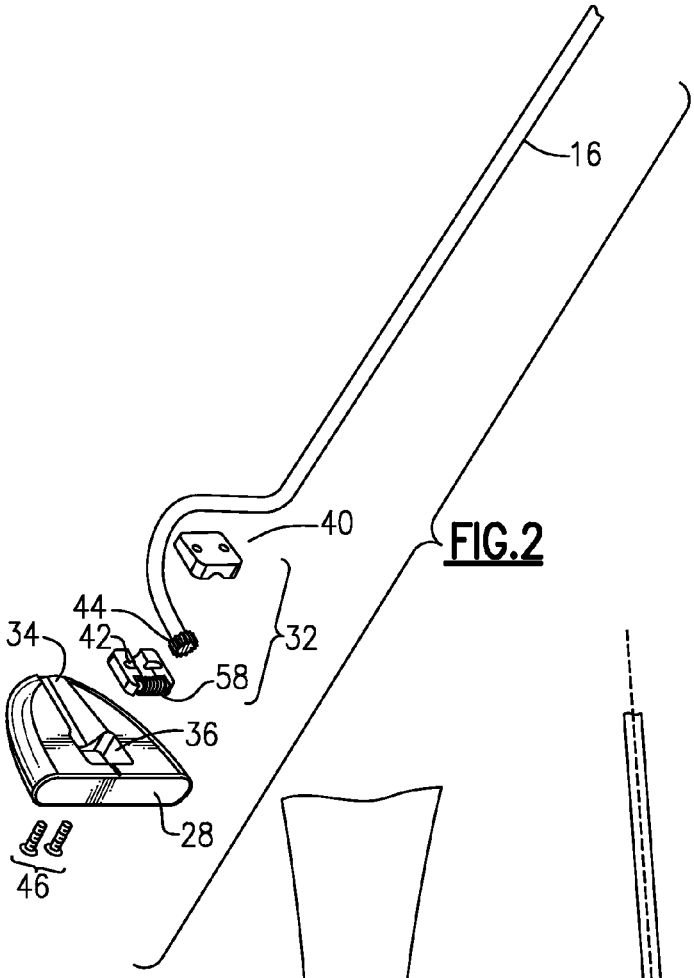
FIG. 2 is a partly exploded perspective view thereof.
Figure 3:
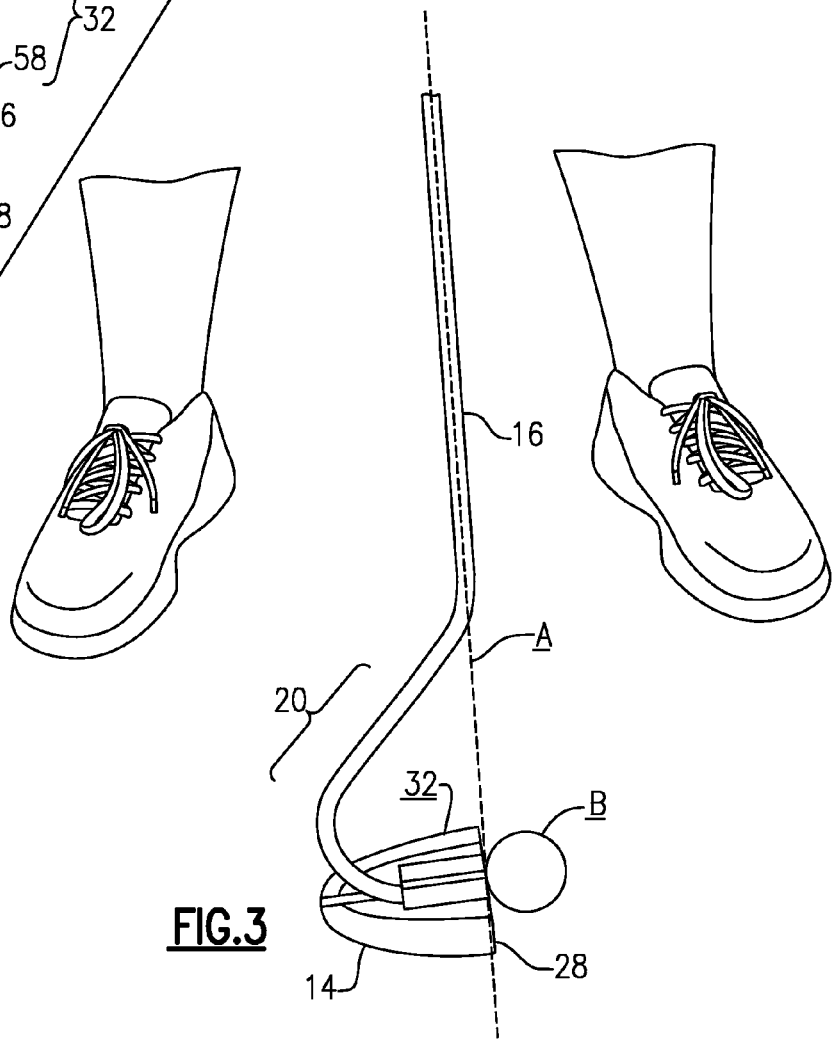
FIG. 3 is another perspective view of this embodiment.

As shown in the exploded assembly view of FIG. 2, the insert 32 is generally formed of an upper clamp plate 40 that attaches to a lower insert body 42, each of which has a generally rectangular profile to match the shape of the insert cavity 36. These capture the tip of the shaft gooseneck portion 20 between them. As shown, a spur gear 44 is affixed to the tip to effect rotation of the shaft along the proximal-distal axis of the club head. A pair of screw fasteners 46 pass through holes (not shown) in the club sole 30, through the lower insert body 42 and into the upper insert clamp plate 40.

Figure 5:
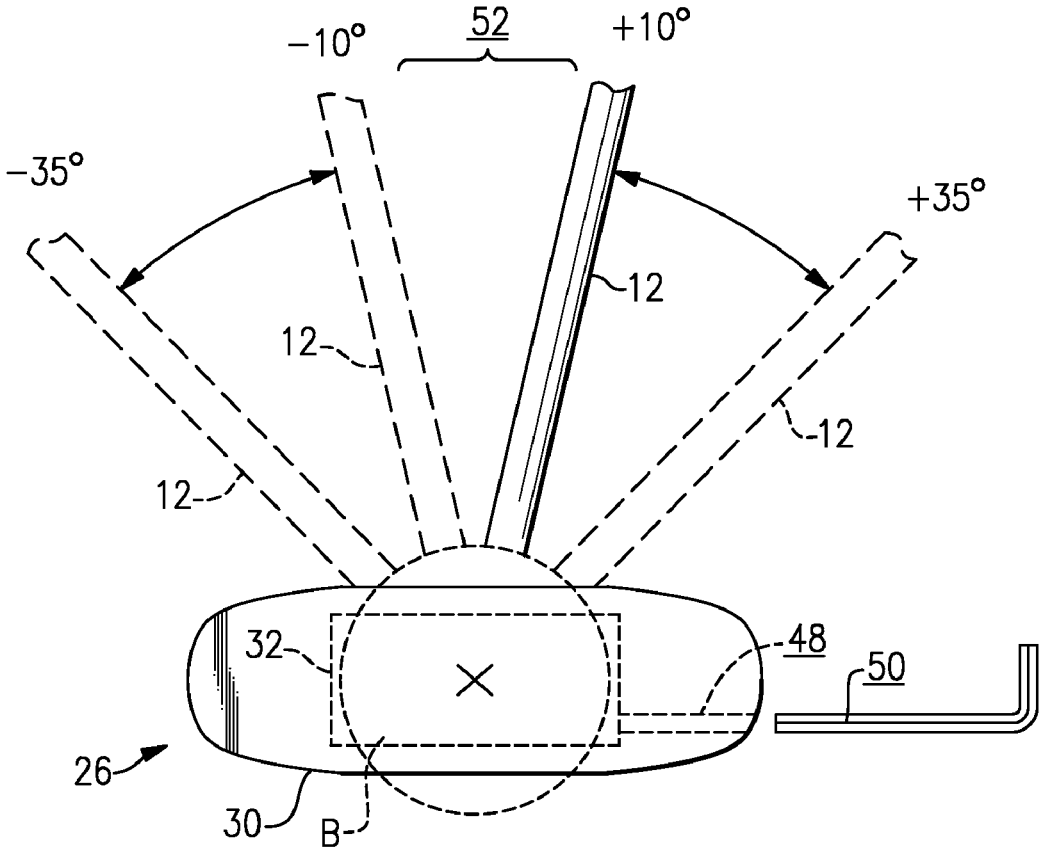
FIG. 5 is a schematic view showing the lie adjustment ranges in this embodiment.

As illustrated schematically in FIG. 5, a worm gear drive (to be detailed shortly) is incorporated into the insert 32, and can be manipulated by an allen wrench or hex wrench 50 that is inserted into a transverse bore 48 at one side of the body 26 of the club head 14. This permits the lie of the axis of the shaft 12 relative to the sole 30 of the club to be adjusted over a continuous range, between +10° from vertical and +35° (for right-handed use) and between −10° and −35° (for left handed use). There is a stop or blocking mechanism in place in the insert such that there is a forbidden zone 52 between +10° and −10° from vertical, so the shaft axis A cannot be set closer than ten degrees from vertical. Also as shown here, the axis of rotation X of the shaft 12 is aligned with the center part of the club face 28 where the putter meets the golf ball B.

Figure 6:
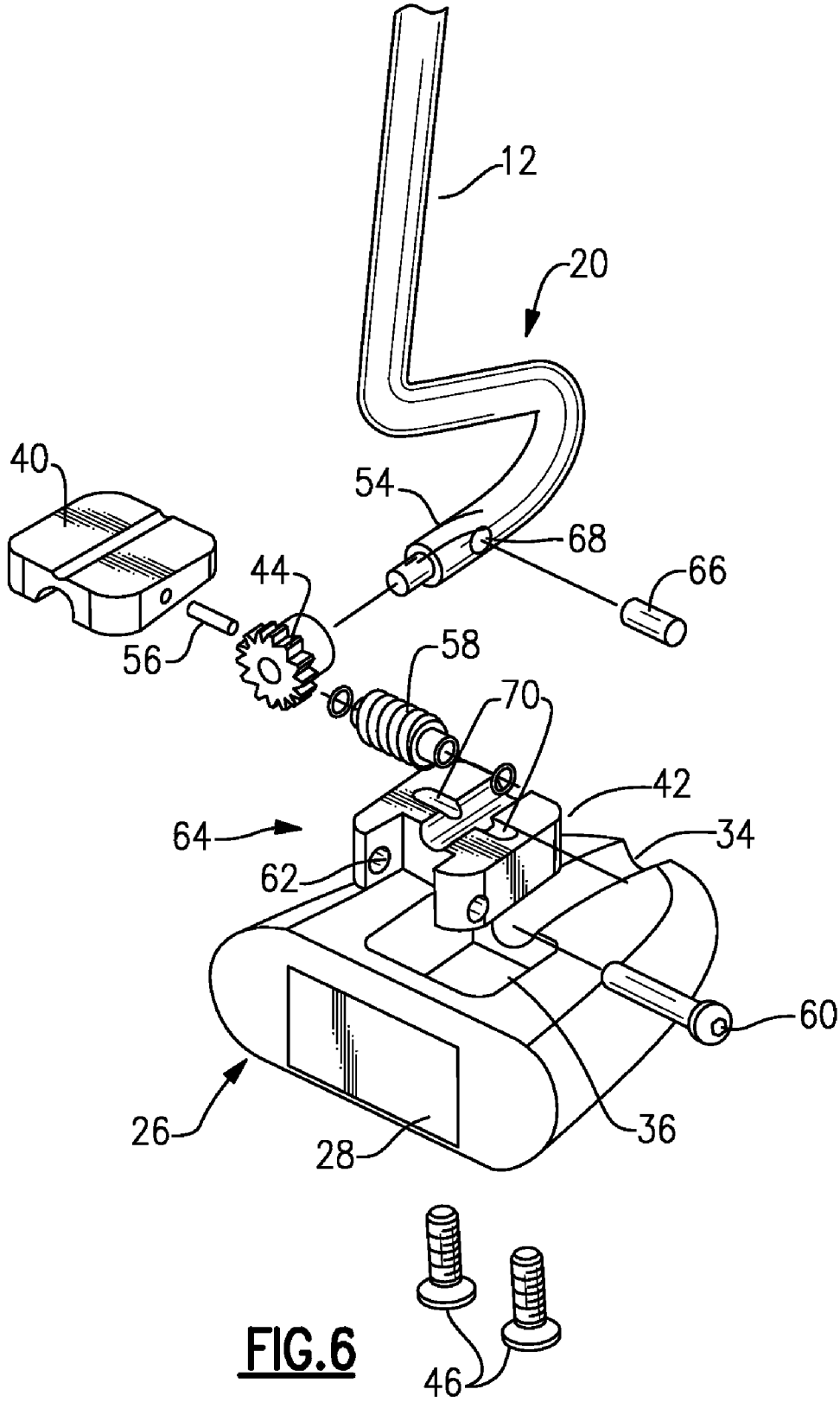
FIG. 6 is a more detailed exploded assembly view of this embodiment.
Figure 7:
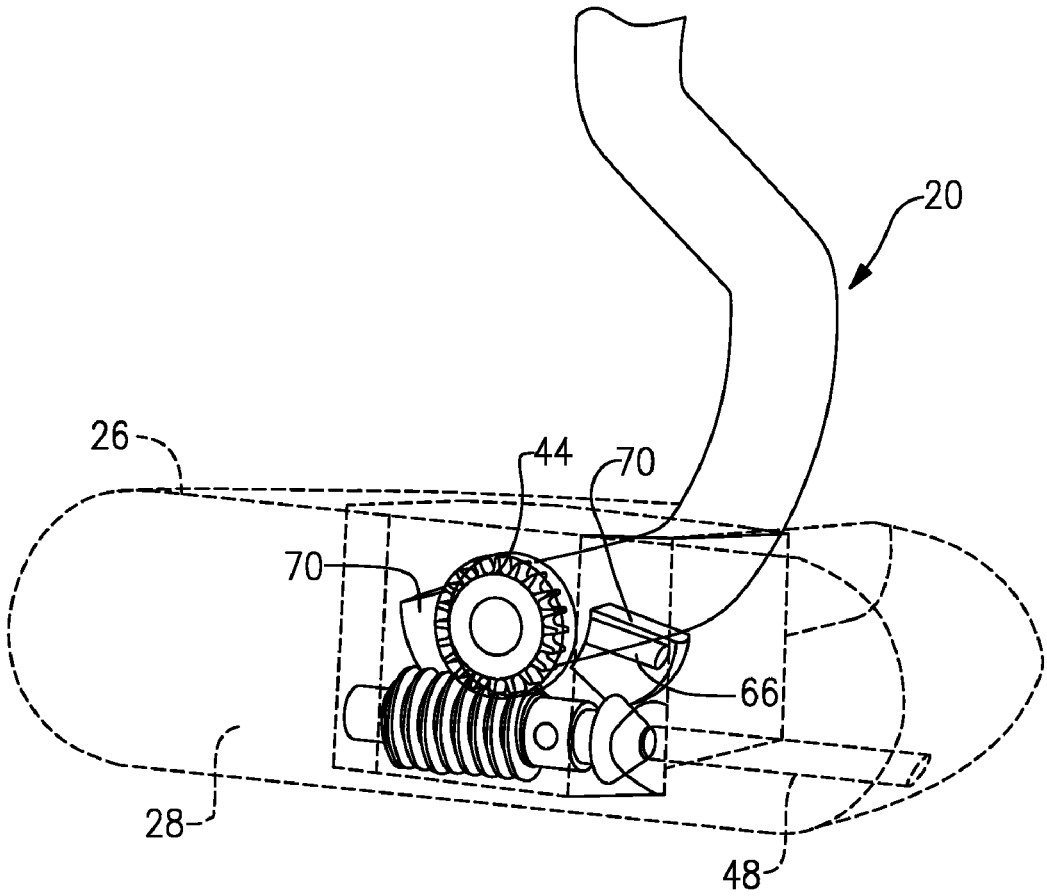
FIG. 7 is a partly cut-away view of the putter head of this embodiment.
Figure 8:
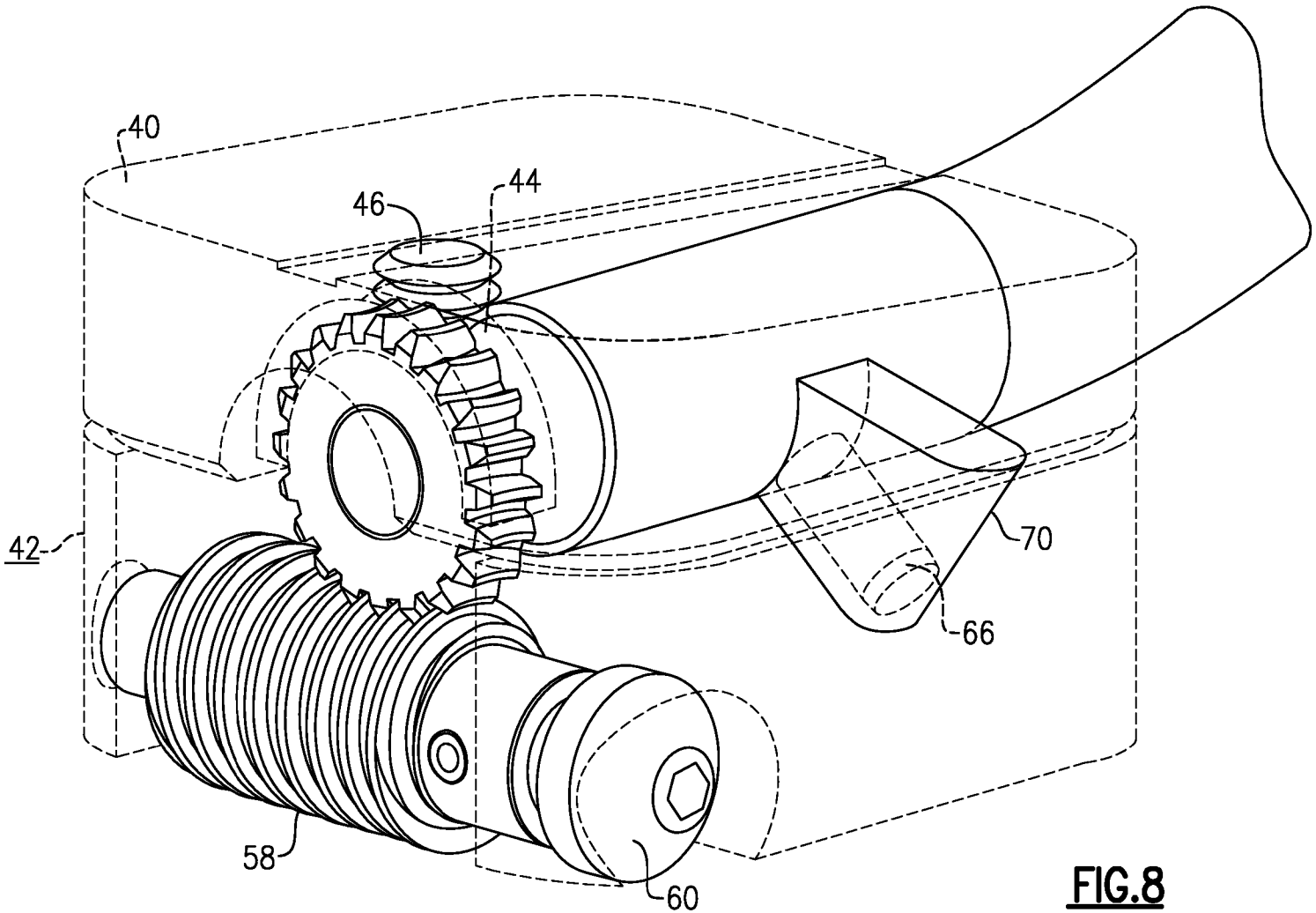
FIG. 8 is a partly cut-away view of a the insert of this embodiment, showing the lie angle adjustment mechanism.

The construction of the insert 32 and the worm-drive adjustment feature of the preferred embodiment is shown in the exploded view of FIG. 6 with further reference to the more detailed views of the club head 14 in FIG. 7 and of the insert 32 in FIG. 8.

As shown in FIG. 6, the spur gear 44 of the worm drive is fitted onto the tip (i.e., horizontal distal end) of the gooseneck portion 20, and is secured to it by means of a pin 56. A worm or helix 58 is supported on an axle 60 and these fit into a distal or forward recess 62 in the lower insert 42, and a pin 64 locks the worm 58 to the axle 60. There is a head at one end of the axle which has a hexagonal recess (see FIGS. 7 and 8) to receive the allen wrench 50. A limit pin 66 is fitted into a bore 68 just behind the tip 54 of the gooseneck, and this protrudes radially out, as shown in FIGS. 7 and 8. There are limit cavities 70 formed on left and right sides of the insert 32 adjacent the gooseneck, and these each have an upper wall formed in the insert clamp plate 40 and a lower limit wall formed in the lower insert 42. These walls interfere with limit pin 66 and keep it from revolving beyond the set rotational limits of 10° and 35° from vertical. By using the allen wrench to rotate the worm 58, it is possible to set the angle of the shaft, i.e., the lie of the putter, at any place in between those limits. The lie is infinitely adjustable within this range, and not merely incrementally adjustable as with other adjustable putters.

The insert 32 can be removed from the club head and the gooseneck 20 can be lifted from it. Then, the limit pin 66 can be pushed though the shaft to the other side and reinstalled in the insert. The insert can then be replaced into the insert cavity 36 and attached with the screws 46. Now the putter is set up for left-hand play, and the pin 66 limits rotation between the opposite angles of lie, i.e., between −10° and −35°. This can be easily carried out in the pro shop or in the store when the club is purchased. Normally, there is no need to reset the club between the LH and RH settings. However, later reconfiguration from LH back to RH is possible, following the same general procedures. The individual golfer can experiment with different lies, i.e., different shaft angles, and quickly arrive at the putter lie that is correct for him or her.

In other possible embodiments, the lie adjustment may be carried out with a different mechanism from the worm drive shown here, and still accomplish infinite adjustment within a range of angles. Also, the invention is not strictly limited to putters having the head of the same shape as is shown in connection with the described embodiment. A variety of mechanisms may be employed for limiting the rotation of the lower goosehead (or hosel in some cases) so that the club remains legal for play according to the established rules.

The club head body may be formed of a metal or of a synthetic resin material, or of a wide range of other suitable materials.

While the invention has been described here with reference to one specific preferred embodiment, it should be recognized that the invention is not limited to that embodiment, and that many modifications and variations would present themselves to those of skill in the art without departure from the scope of this invention, as defined in the appended claims.

I claim:

1. A golf putter comprising a head and a shaft;

the head including a body with a sole, a face at a distal end thereof and a back at a proximal end thereof;

the shaft having a main straight elongated shaft portion that defines a shaft axis, and a gooseneck portion at a lower end of the main shaft portion, the gooseneck portion turning proximally from the plane of the shaft axis at said lower end of the main shaft portion and then curving through more than 90 degrees towards the distal direction such that a lower end of the gooseneck portion lies in a horizontal plane perpendicular to the shaft axis;

said head portion including an insert cavity and an insert removably secured into said insert cavity; and means in said insert for capturing the tip of said gooseneck portion and holding the same, said means permitting adjustment of the lie of the shaft relative to the sole of the club head, between limits of substantially 10 degrees from vertical relative to the sole and a maximum angle between said 10 degrees and horizontal; and in which the means for adjustably capturing the tip of the gooseneck portion and permitting adjustment of the lie of the shaft includes a worm drive, with a spur gear retained on the tip of the gooseneck portion and a worm gear that is transversely disposed in said insert and is accessible through a bore in the club head.

2. A golf putter according to claim 1, wherein said insert holds the gooseneck portion of the shaft such that the axis of the shaft lies in or ahead of the plane of the club face.

3. A golf putter according to claim 1, in which the insert includes a blocking device preventing rotation of the gooseneck portion to any angle less than 10 degrees from vertical of the shaft axis relative to the club sole.

4. A golf putter according to claim 3, wherein said blocking device can be adjusted to permit the lie of the shaft to be set to either side of vertical, so that the putter can be adjusted for either right-handed or left-handed play.

5. A golf putter comprising a head and a shaft;

the head including a body with a sole, a face at a distal end thereof and a back at a proximal end thereof;

the shaft having a main straight elongated shaft portion that defines a shaft axis, and a gooseneck portion at a lower end of the main shaft portion, the gooseneck portion turning proximally from the plane of the shaft axis at said lower end of the main shaft portion and then curving through more than 90 degrees towards the distal direction such that a lower end of the gooseneck portion lies in a horizontal plane perpendicular to the shaft axis;

said head portion including an insert cavity and an insert removably secured into said insert cavity; and means in said insert for capturing the tip of said gooseneck portion and holding the same, said means permitting adjustment of the lie of the shaft relative to the sole of the club head, between limits of substantially 10 degrees from vertical relative to the sole and a maximum angle between said 10 degrees and horizontal; and wherein said insert is formed of a lower base portion and an upper clamp portion that releasably secure the tip of the gooseneck portion therebetween.

6. A golf putter according to claim 5, in which said base and clamp portions define at least one limit cavity between them, and the tip of the gooseneck portion includes a limit pin extending radially therefrom and disposed within said limit cavity, with walls of the limit cavity defining rotational limits for said gooseneck portion.

7. A golf putter according to claim 5, wherein the lie of the shaft can be infinitely adjusted between said limits.

8. A golf putter comprising a head and a shaft;

the head including a body with a sole, a face at a distal end thereof and a back at a proximal end thereof;

the shaft having a main straight elongated shaft portion that defines a shaft axis, and a gooseneck portion at a lower end of the main shaft portion, the gooseneck portion turning proximally from the plane of the shaft axis at said lower end of the main shaft portion and then curving through more than 90 degrees towards the distal direction such that a lower end of the gooseneck portion lies in a horizontal plane perpendicular to the shaft axis;

said head portion including an insert cavity and an insert removably secured into said insert cavity; and means in said insert for capturing the tip of said gooseneck portion and holding the same, said means permitting adjustment of the lie of the shaft relative to the sole of the club head, between limits of substantially 10 degrees from vertical relative to the sole and a maximum angle between said 10 degrees and horizontal; and wherein said insert is in the form of a generally rectangular block fitted into said insert cavity.

9. A golf putter according to claim 8, said head portion including a trough that extends from the back of said head to the insert cavity so that the horizontal lower end of the gooseneck portion lies within said trough.

10. A golf putter according to claim 9, wherein said trough has a generally C-shaped cross section.

* * * * *